US006170206B1

(12) United States Patent
Coolman

(10) Patent No.: US 6,170,206 B1
(45) Date of Patent: Jan. 9, 2001

(54) CUPOLA ROOF PANELS WITH SNAP-FIT EDGES

(75) Inventor: David W. Coolman, Plymouth, WI (US)

(73) Assignee: Plyco Corporation, Elkhart Lake, WI (US)

( * ) Notice: Under 35 U.S.C. 154(b), the term of this patent shall be extended for 0 days.

(21) Appl. No.: 09/394,477

(22) Filed: Sep. 11, 1999

(51) Int. Cl.[7] ..... E04B 7/18

(52) U.S. Cl. ..... 52/200; 52/284; 52/82; 52/91.1; 52/91.3; 52/262

(58) Field of Search ..... 52/219, 218, 200, 52/82, 91.1, 91.3, 262, 270, 284

(56) References Cited

U.S. PATENT DOCUMENTS

| | | | | |
|---|---|---|---|---|
| 817,508 | * | 4/1906 | Niele | 52/91.1 |
| 968,061 | * | 8/1910 | Kramer | 52/82 |
| 1,116,244 | * | 11/1914 | Conner | 52/82 |
| 1,137,689 | * | 4/1915 | Allsteadt | 52/82 |
| 1,145,202 | * | 7/1915 | McFarland | 52/82 X |
| 1,176,000 | * | 3/1916 | Smith | 52/82 |
| 1,242,935 | * | 10/1917 | Harrison | 52/82 |
| 1,643,934 | * | 9/1927 | Flagge | 52/91.3 X |
| 1,977,391 | * | 10/1934 | Kramer | 52/82 X |
| 2,742,116 | * | 8/1956 | Fitzgerald | 52/82 |
| 2,802,487 | * | 8/1957 | Breehl | 52/284 X |
| 2,828,046 | * | 3/1958 | Weinamn | 52/284 X |
| 2,952,799 | * | 9/1960 | Wortman et al. | 52/284 X |
| 3,218,773 | * | 11/1965 | Heirich | 52/262 X |
| 3,274,739 | * | 9/1966 | Gregoire | 52/91.3 X |
| 3,373,533 | * | 3/1968 | Trelfa et al. | 52/284 X |
| 3,466,832 | * | 9/1969 | March | 52/262 X |
| 4,784,172 | * | 11/1988 | Yacoboni | 52/82 X |

FOREIGN PATENT DOCUMENTS

| | | | | |
|---|---|---|---|---|
| 456265 | * | 5/1949 | (CA) | 52/284 |
| 335189 | * | 9/1930 | (GB) | 52/82 |
| 664405 | * | 1/1952 | (GB) | 52/82 |

* cited by examiner

*Primary Examiner*—Peter M. Cuomo
*Assistant Examiner*—Rodney B. White
(74) *Attorney, Agent, or Firm*—Donald J. Ersler

(57) ABSTRACT

A cupola roof having cupola roof panels with snap-fit edges preferably includes four roof panels. In a first embodiment, there are four combination cupola roof panels. Each combination cupola roof panel has a female snap-fit edge on one side and a male snap-fit edge on the other side. In a second embodiment their are two male cupola roof panels and two female cupola roof panels. The male cupola roof panel has a male snap-fit edge disposed on each side thereof. The female cupola roof panel has a female snap-fit edge disposed on each side thereof.

18 Claims, 6 Drawing Sheets

CUPOLA ROOF PANELS WITH SNAP-FIT EDGES

BACKGROUND OF THE INVENTION

1. Field of the Invention

The present invention relates generally to cupolas and more specifically to cupola roof panels with snap-fit edges which are easier to assemble than that of the prior art.

2. Discussion of the Prior Art

Cupola roof panels are typically assembled by sliding a roof connector over turned-up ends of two adjacent roof panels. The problem with the prior art assembly method is that it is time consuming and strenuous. Sometimes, the turned-up end of each roof panel will displace relative to each other with the result that the roof may disassemble and be destroyed by the wind. Further, the cupola panels must be slightly curved so that the roof connector does not slide off. It is very expensive and time consuming from a manufacturing standpoint to make curved turned-up edges on each roof panel.

Accordingly, there is a clearly felt need in the art for cupola roof panels with snap-fit edges which allow secure sealing of the roof panels to each other, and for quick and non-fatiguing assembly.

SUMMARY OF THE INVENTION

The primary objective of the present invention is to provide a cupola roof panels with snap-fit edges which allow secure sealing of the roof panels to each other, and for quick and non-fatiguing assembly.

According to the present invention, a cupola roof having cupola roof panels with snap-fit edges preferably includes four roof panels. In a first embodiment, their are four combination cupola roof panels. Each combination cupola roof panel has a female snap-fit edge on one side and a male snap-fit edge on the other side. In a second embodiment, their are two male cupola roof panels and two female cupola roof panels. The male cupola roof panel has a male snap-fit edge disposed on each side thereof. The female cupola roof panel has a female snap-fit edge disposed on each side thereof.

At assembly, in the first embodiment, two combination cupola roof panels may be inserted into the cupola base adjacent each other. The bottom of each combination cupola roof panel is slid on to the cupola base. The two remaining cupola panels are slid on to the cupola base and positioned such that the female snap-fit edges are aligned with the male snap-fit edges; the female snap-fit edges are then snapped over the male snap-fit edges.

At assembly, in the second embodiment, the male cupola roof panels are inserted into the cupola base opposite each other. The bottom of each male cupola roof panel is slid on to the cupola base. The female cupola panels are then slid on to the cupola base and positioned such that the female snap-fit edges are aligned with the male snap-fit edges; the female snap-fit edges are then snapped over the male snap-fit edges.

Accordingly, it is an object of the present invention to provide cupola roof panels which may be quickly assembled together.

It is a further object of the present invention to provide cupola roof panels which may be assembled by expending less physical energy than that of the prior art.

Finally, it is another object of the present invention to provide cupola roof panels which may be connected together such that they do not leak.

These and additional objects, advantages, features and benefits of the present invention will become apparent from the following specification.

DETAILED DESCRIPTION OF THE PREFERRED EMBODIMENTS

Figure 1:
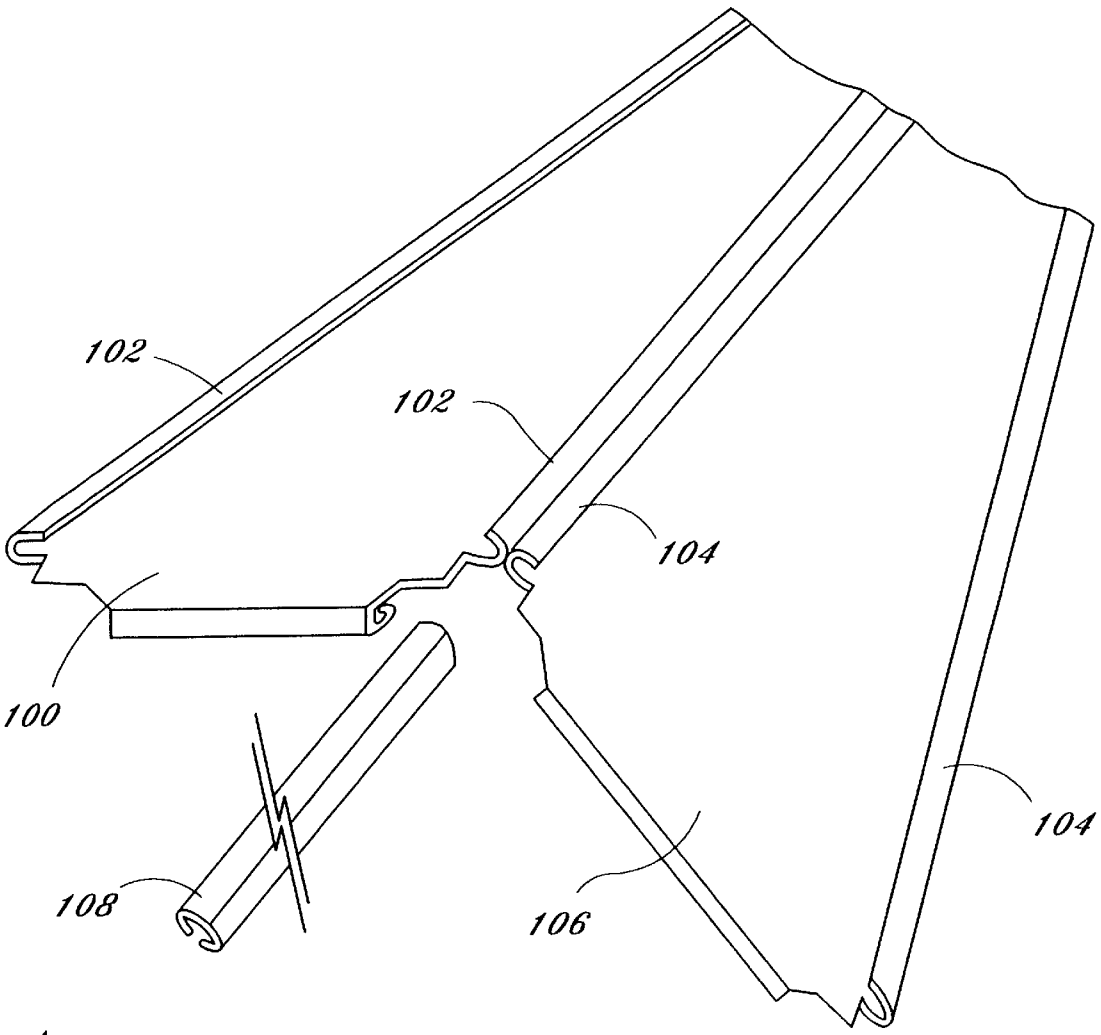
FIG. 1 (PRIOR ART)
FIG. 1 is a partially exploded perspective view of a prior art roof connector before assembly to two adjacent cupola roof panels
Figure 2:
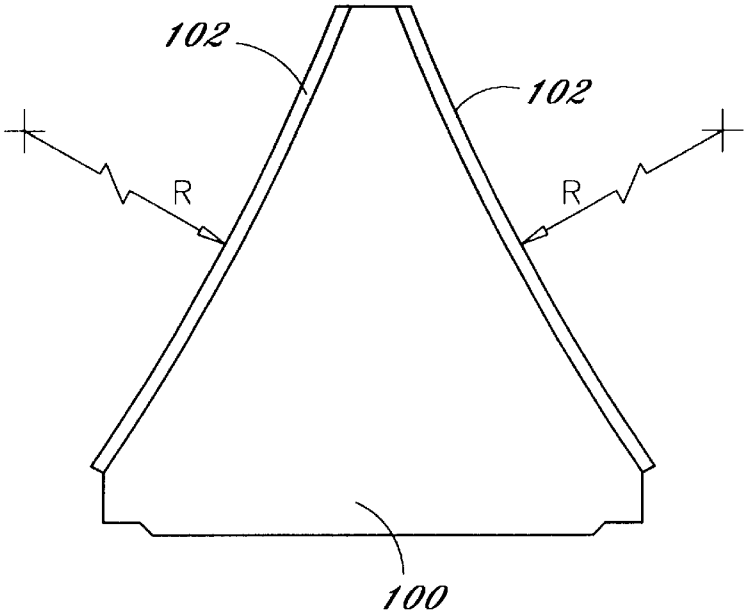
FIG. 2 (PRIOR ART)
FIG. 2 is a front view of a prior art cupola roof panel illustrating the curvature of the turned-up edges.
Figure 3:
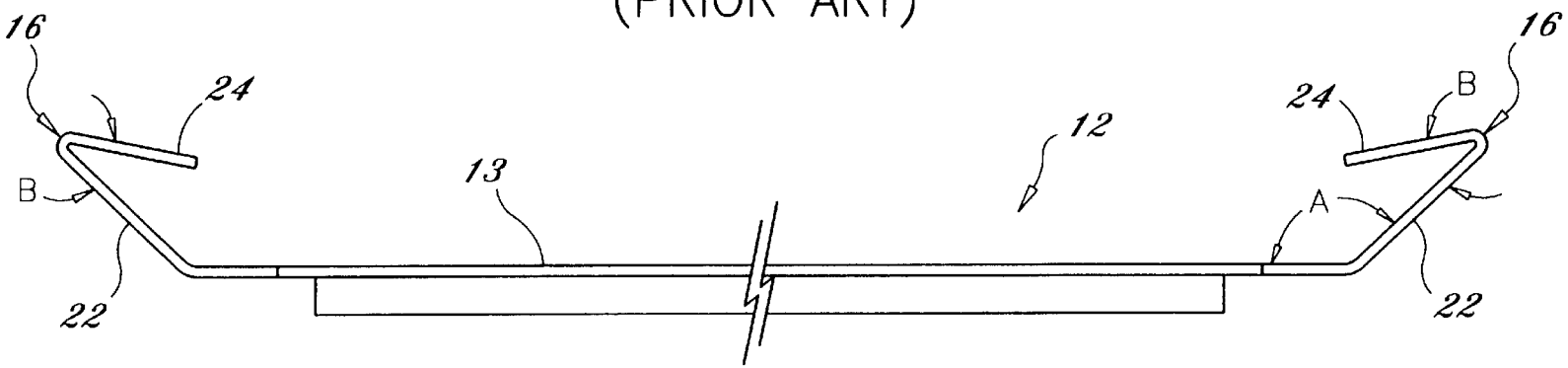
FIG. 3 is an end view of a male cupola roof panel in accordance with the present invention.
Figure 4:
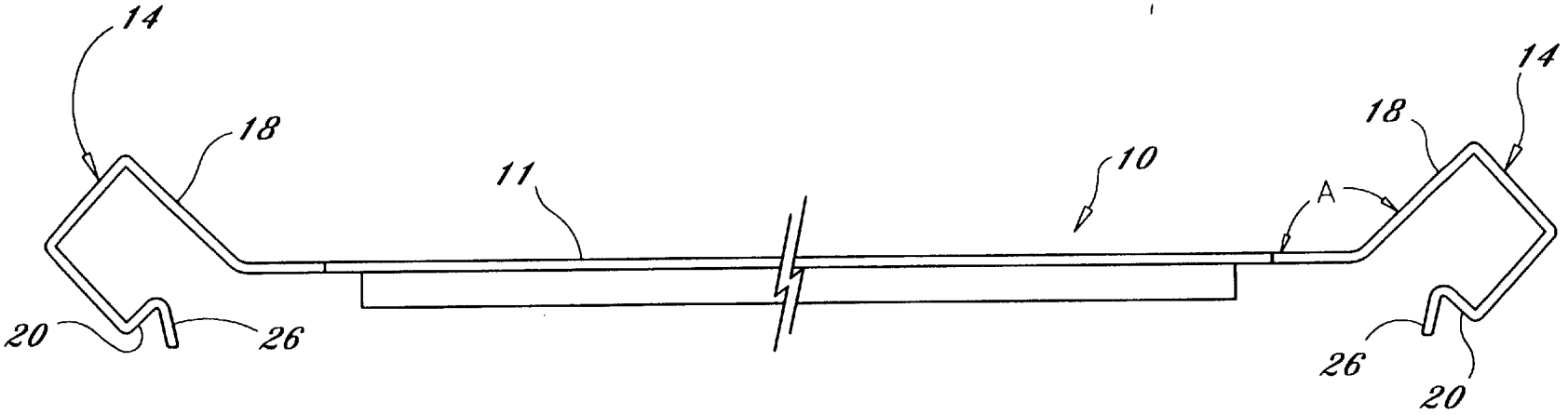
FIG. 4 is an end view of a female cupola roof panel in accordance with the present invention.

With reference now to the drawings, and particularly to FIG. 1, there is shown a partially exploded perspective view of a roof connector 108 before assembly to a first cupola roof panel 100 which is adjacent to a second cupola roof panel 106. A first turned-up edge 102 is retained against a second turned-up edge 104 with the roof connector 108. FIG. 2 shows a front view of the first cupola roof panel 100 having two first turned-up edges 102. Both first turned-up edges 102 have a curvature R along their length to retain the roof connector 108.

Figure 5:
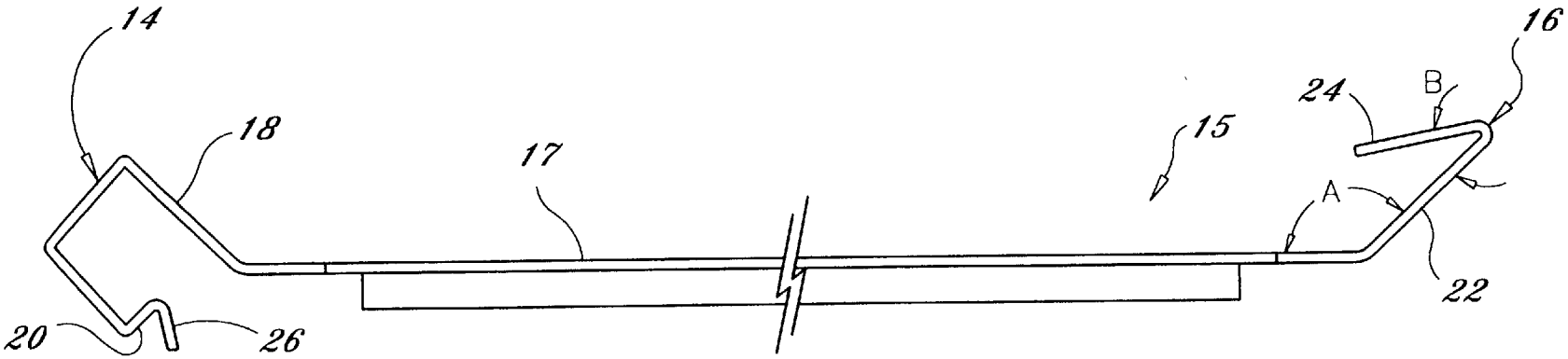
FIG. 5 is an end view of a combination cupola roof panel in accordance with the present invention.
Figure 8:
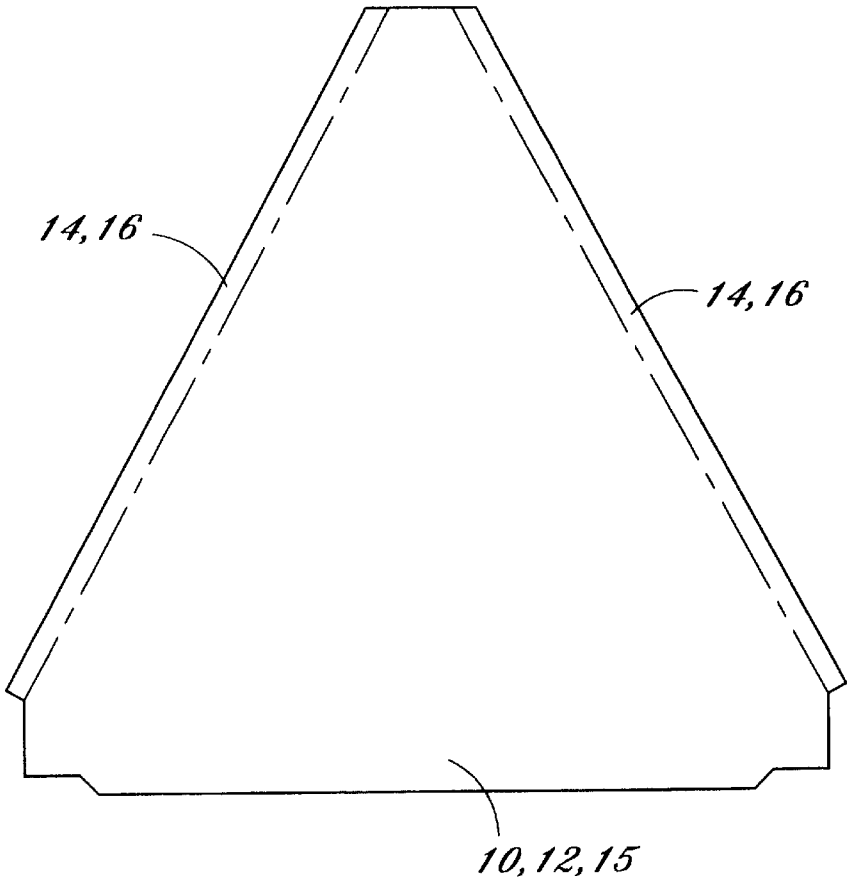
FIG. 8 is a front view of a male, female, or combination cupola roof panel with snap-fit edges in accordance with the present invention.
Figure 9:
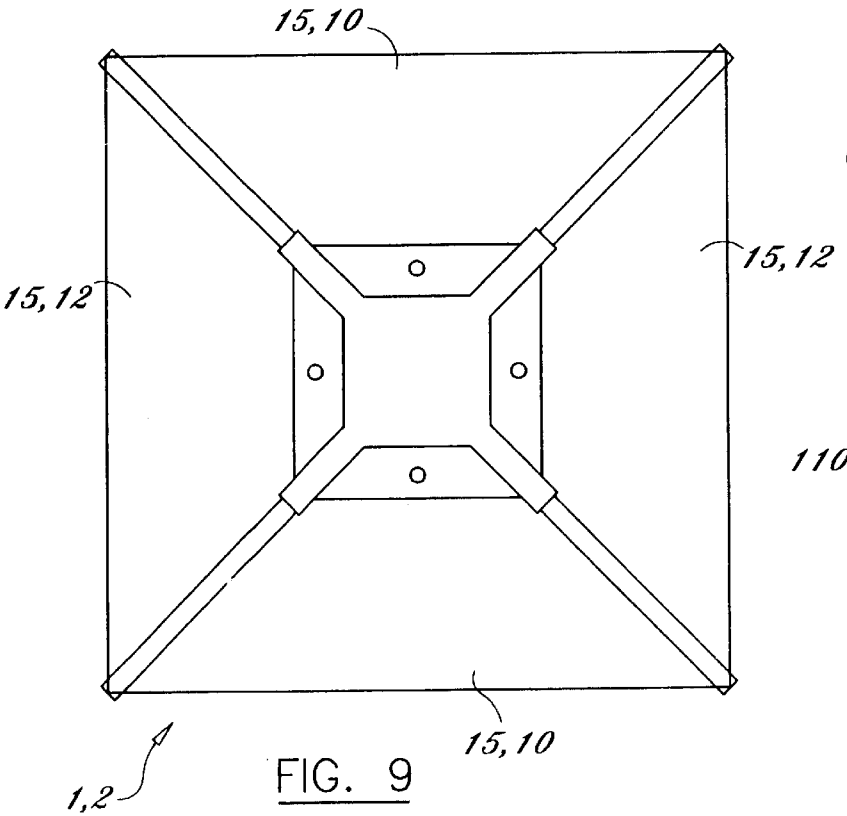
FIG. 9 is a top view of an assembled cupola having cupola roof panels with snap-fit edges in accordance with the present invention.

With reference to FIGS. 5 and 9, a cupola roof having cupola roof panels with snap-fit edges 1 includes four combination roof panels 15. With reference to FIGS. 3, 4, 7 and 8, a cupola roof having cupola roof panels with snap-fit edges 2 includes two female cupola roof panels 10 and two male cupola roof panels 12. The cupola roof panels with snap-fit edges are preferably fabricated from steel sheet with a non-corrosive treatment, such as galvanized steel. The combination cupola roof panel 15 has a female snap-fit edge 14 on one side and a male snap-fit edge 16 on the other side thereof. The female cupola roof panel 10 has a female snap-fit edge 14 disposed on each side thereof. The male cupola roof panel 12 has a female snap-fit edge 16 disposed on each side thereof.

The female snap-fit edge 14 includes a female channel 18 an inward facing retention lip 20, and a tab 26. The female channel 18 is preferably shaped substantially as a rectangle with the retention lip 20 disposed on a bottom thereof. However, the female channel 18 could be any shape which accommodates the insertion of the female snap-fit edge 14.

The retention lip 20 preferably extends inwardly from the bottom of the female channel 18 at a substantially perpendicular angle. The tab 26 extends outward from an end of the retention lip 20. The tab 26 facilitates insertion of a retention leg 24 of the male snap-fit edge 16. With a combination roof cupola roof panel 15, the female channels 18 are offset from the body 17 thereof at an angle A. With a female cupola roof panel 10, the female channel 18 is also offset from the body 11 thereof at an angle A.

The male snap-fit edge 16 has a generally triangular shape. The combination cupola roof panel 15 has a male snap-fit edge 16 which includes a projection leg 22 that is offset from the body 17 at an angle A. The male cupola roof panel 12 has a male snap-fit edge 16 which includes a projection leg 22 which is offset from the body 13 at an angle A. The angle A is the same for both the male and female cupola roof panels with snap-fit edges to ensure that thereof are square to each other. The retention leg 24 extends outward from the projection leg 22 at an angle B.

Figure 6:
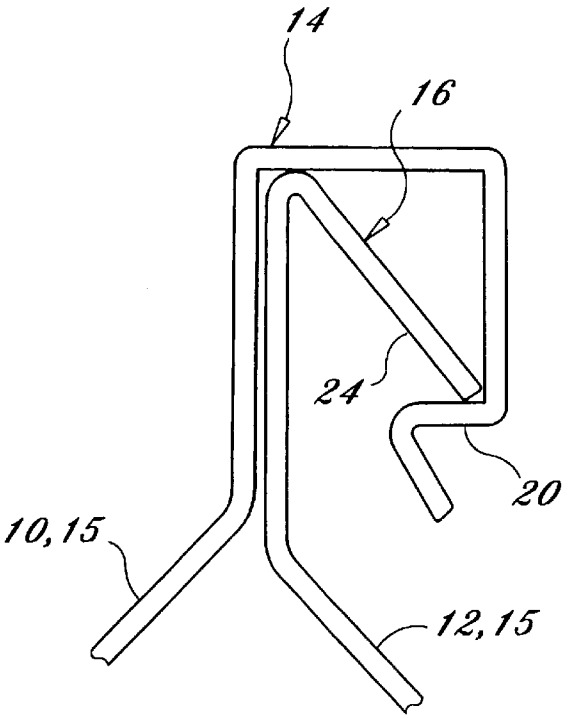
FIG. 6 is an end view of a male snap-fit edge inserted into a female snap-fit edge of in accordance with the present invention.

With reference to FIG. 6, the retention leg 24 is angled to facilitate insertion into the female channel 14. The male snap-fit edge 16 is retained inside the female snap-fit edge 14 when the retention leg 24 of the male snap-fit edge 16 is retained behind the retention lip 20 of the female snap-fit edge 14.

The following dimensions are given by way of example and not by way of limitation. Preferably, angle A has a value of between 110–130 degrees. Angle B preferably has a value of between 20–40 degrees.

Figure 7:
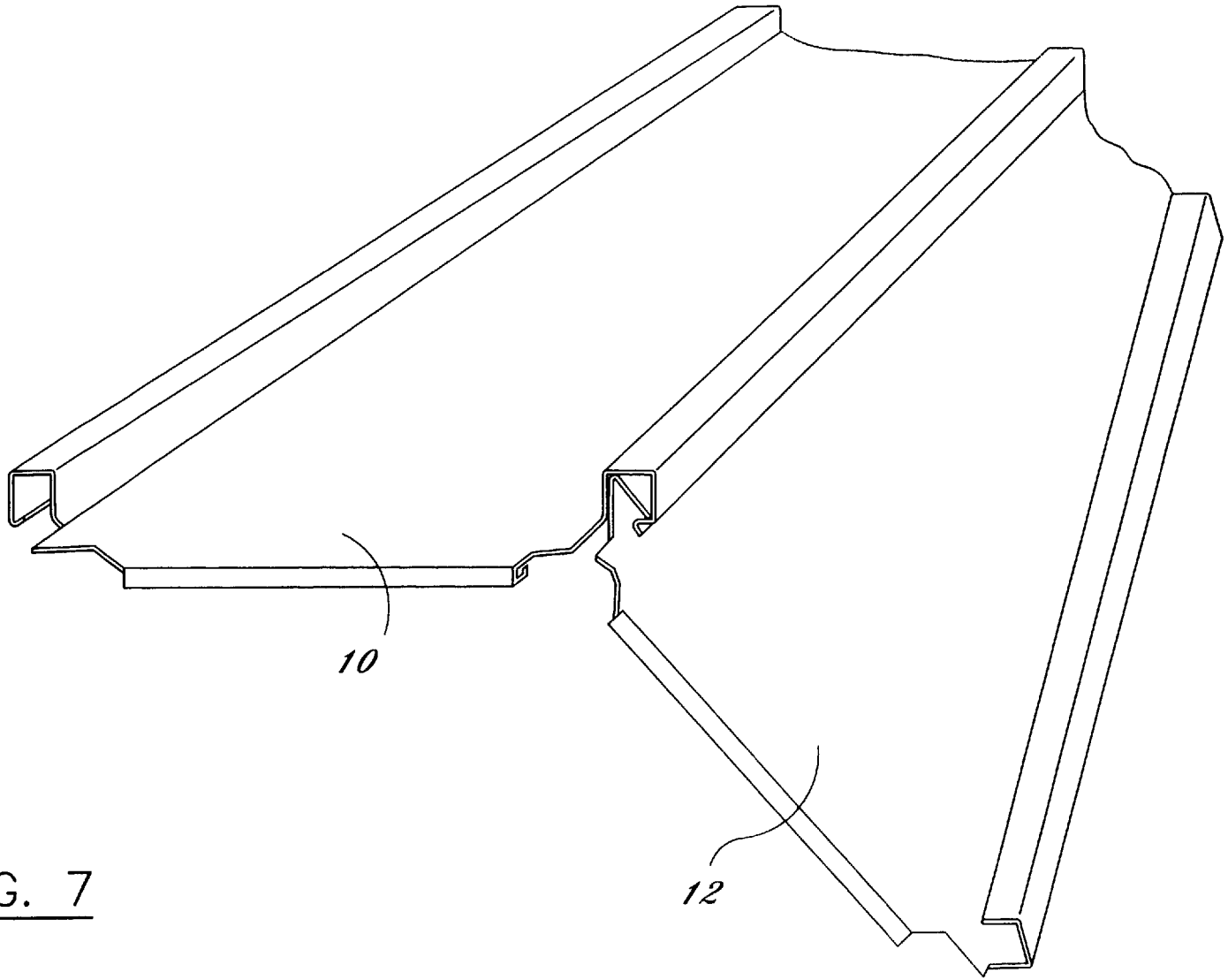
FIG. 7 is a perspective view of a male cupola roof panel attached to a female cupola roof panel in accordance with the present invention.

FIG. 7 shows a perspective view of a female cupola roof panel 10 assembled to a male cupola roof panel 12. FIG. 8 shows a front view of a male, female, or combination roof panel. FIG. 9 shows a top view of four combination roof panels 15 assembled to each other, or two female cupola roof panels 10 assembled to two male cupola roof panels 12. Combination cupola roof panels 15 may be assembled adjacent to each other. The two female cupola roof panels 10 must be assembled opposite each other and the two male roof panels 12 must also be assembled opposite each other.

Figure 10:
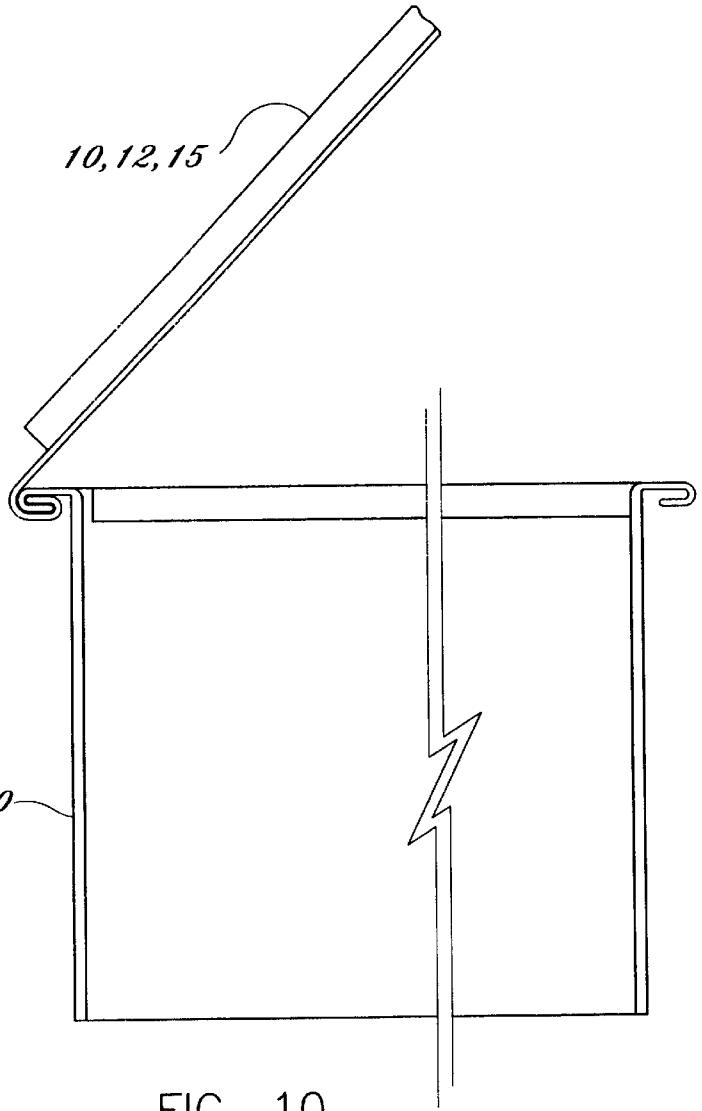
FIG. 10 is a side view of a cupola roof panel with snap-fit edges attached to a cupola base in accordance with the present invention.

With reference to FIG. 10, for the first embodiment, the bottoms of two combination cupola roof panels may be slid on to a cupola base 110 adjacent each other. The two remaining cupola panels are slid on to the cupola base and positioned such that the female snap-fit edges 14 are aligned with the male snap-fit edges 16; the female snap-fit edges 14 are then snapped over the male snap-fit edges 16. With reference to FIG. 9, for the second embodiment, the bottoms of the female cupola panels 10 are then slid on to the cupola base 110 and aligned such that the female snap-fit edges 14 are aligned with the male snap-fit edges 16; the female snap-fit edges 14 are snapped over the male snap-fit edges 16.

Although, a cupola roof having four cupola roof panels with snap-fit edges has been shown and described, the invention should not be limited to only four cupola roof panels, but the cupola roof could include 3, 5, or more cupola roof panels with snap-fit edges.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A cupola roof panel with snap-fit edges for a cupola roof, comprising:

a cupola roof panel having a top edge, bottom edge and two side edges;

a female snap-fit edge is disposed on one said side edge, said female snap-fit edge including a female channel offset from said female cupola roof panel at an obtuse angle, said female channel being terminated with a retention lip facing inward toward a center of said cupola roof panel; and a male snap-fit edge is disposed on the other said side edge, wherein said female snap-fit edge of said cupola roof panel being assembled to an adjacent male snap-fit edge of another cupola roof panel, said male snap-fit edge of said cupola roof panel is assembled to an adjacent female snap-fit edge of another cupola roof panel.

2. The cupola roof panel with snap-fit edges for a cupola roof of claim 1, further comprising:

a tab extending outward from an end of said retention lip.

3. The cupola roof panel with snap-fit edges for a cupola roof of claim 1, wherein:

said male snap-fit edge including a projection leg offset from said male cupola roof panel at an obtuse angle, a retention leg extending from said projection leg, said male snap-fit edge is inserted into said female snap-fit edge until said retention leg is retained behind said retention lip.

4. A cupola roof panel with snap-fit edges for a cupola roof, comprising:

a cupola roof panel having a top edge, bottom edge and two side edges;

a female snap-fit edge is disposed on one said side edge; and a male snap-fit edge is disposed on the other said side edge, said male snap-fit edge including a projection leg offset from said male cupola roof panel at an obtuse angle, a retention leg extending from said projection leg, wherein said male snap-fit edge is inserted into said female snap-fit edge until said retention leg is retained behind said retention lip, said female snap-fit edge of said cupola roof panel is assembled to an adjacent male snap-fit edge of another cupola roof panel, said male snap-fit edge of said cupola roof panel is assembled to an adjacent female snap-fit edge of another cupola roof panel.

5. The cupola roof panel with snap-fit edges for a cupola roof of claim 4, wherein:

said female snap-fit edge including a female channel offset from said female cupola roof panel at an obtuse angle, said female channel is terminated with a retention lip facing inward toward a center of said cupola roof panel.

6. The cupola roof panel with snap-fit edges for a cupola roof of claim 5, further comprising:

a tab extending outward from an end of said retention lip.

7. A cupola roof panel with snap-fit edges for a cupola roof, comprising:

a cupola roof panel having a top edge, bottom edge and two side edges;

a female snap-fit edge is disposed on one said side edge, said female snap-fit edge including a female channel offset from said female cupola roof panel at an obtuse angle, said female channel being terminated with a retention lip facing inward toward a center of said cupola roof panel; and a male snap-fit edge is disposed on the other said side edge, said male snap-fit edge including a projection leg offset from said male cupola roof panel at an obtuse angle, a retention leg extending from said projection leg, wherein said male snap-fit edge is inserted into said female snap-fit edge until said retention leg is retained behind said retention lip, said female snap-fit edge of said cupola roof panel is assembled to an adjacent male snap-fit edge of another cupola roof panel, said male snap-fit edge of said cupola roof panel is assembled to an adjacent female snap-fit edge of another cupola roof panel.

8. The cupola roof panel with snap-fit edges for a cupola roof of claim 7, further comprising:

a tab extending outward from an end of said retention lip.

9. A cupola roof having cupola roof panels with snap-fit edges comprising:

a female cupola roof panel having a top edge, bottom edge and two female side edges;

a female snap-fit edge is disposed on each said female side edge, each said female snap-fit edge including a female channel offset from said female cupola roof panel at an obtuse angle, said female channel is terminated with a retention lip facing inward toward a center of said female cupola roof panel; and a male cupola roof panel having a top edge, bottom edge and two male side edges;

a male snap-fit edge is disposed on each said male side edge, wherein each said female snap-fit edge of said female cupola roof panel is assembled to an adjacent male snap-fit edge of an adjacent male cupola roof panel, each said male snap-fit edge of said male cupola roof panel is assembled to an adjacent female snap-fit edge of another female cupola roof panel.

10. The cupola roof having cupola roof panels with snap-fit edges of claim 9, further comprising:

a tab extending outward from an end of said retention lip.

11. The cupola roof having cupola roof panels with snap-fit edges of claim 9, wherein:

each said male snap-fit edge including a projection leg offset from said male cupola roof panel at an obtuse angle, a retention leg extending from said projection leg, said male snap-fit edge is inserted into said female snap-fit edge until said retention leg is retained behind said retention lip.

12. A cupola roof having cupola roof panels with snap-fit edges comprising:

a female cupola roof panel having a top edge, bottom edge and two female side edges;

a female snap-fit edge is disposed on each said female side edge;

a male cupola roof panel having a top edge, bottom edge and two male side edges; and a male snap-fit edge is disposed on each said male side edge, each said male snap-fit edge including a projection leg offset from said male cupola roof panel at an obtuse angle, a retention leg extending from said projection leg, wherein said male snap-fit edge is inserted into said female snap-fit edge until said retention leg is retained behind said retention lip, each said female snap-fit edge of said female cupola roof panel is assembled to an adjacent male snap-fit edge of an adjacent male cupola roof panel, each said male snap-fit edge of said male cupola roof panel is assembled to an adjacent female snap-fit edge of another female cupola roof panel.

13. The cupola roof having cupola roof panels with snap-fit edges of claim 12, further comprising:

a tab extending outward from an end of said retention lip.

14. The cupola roof having cupola roof panels with snap-fit edges of claim 12, wherein:

each said female snap-fit edge including a female channel offset from said female cupola roof panel at an obtuse angle, said female channel is terminated with a retention lip facing inward toward a center of said female cupola roof panel.

15. A cupola roof having cupola roof panels with snap-fit edges comprising:

a female cupola roof panel having a top edge, bottom edge and two female side edges;

a female snap-fit edge is disposed on each said female side edge, each said female snap-fit edge including a female channel offset from said female cupola roof panel at an obtuse angle, said female channel is terminated with a retention lip facing inward toward a center of said female cupola roof panel;

a male cupola roof panel having a top edge, bottom edge and two male side edges; and a male snap-fit edge is disposed on each said male side edge, each said male snap-fit edge including a projection leg offset from said male cupola roof panel at an obtuse angle, a retention leg extending from said projection leg, wherein said male snap-fit edge is inserted into said female snap-fit edge until said retention leg is retained behind said retention lip, each said female snap-fit edge of said female cupola roof panel is assembled to an adjacent male snap-fit edge of an adjacent male cupola roof panel, each said male snap-fit edge of said male cupola roof panel is assembled to an adjacent female snap-fit edge of another female cupola roof panel.

16. The cupola roof having cupola roof panels with snap-fit edges of claim 15, further comprising:

a tab extending outward from an end of said retention lip.

17. A cupola roof having cupola roof panels with snap-fit edges comprising:

at least two female cupola roof panels, each said female having a top edge, bottom edge and two female side edges;

a female snap-fit edge is disposed on each said female side edge, each said female snap-fit edge including a female channel offset from said female cupola roof panel at an obtuse angle, said female channel is terminated with a retention lip facing inward toward a center of said female cupola roof panel, a tab extending outward from an end of said retention lip;

at least two male cupola roof panels, each said male cupola roof panel having a top edge, bottom edge and two male side edges; and a male snap-fit edge is disposed on each said male side edge, each said male snap-fit edge including a projection leg offset from said male cupola roof panel at an obtuse angle, a retention leg extending from said projection leg, wherein said male snap-fit edge is inserted into said female snap-fit edge until said retention leg is retained behind said retention lip, each said female snap-fit edge of said female cupola roof panel is assembled to an adjacent male snap-fit edge of an adjacent male cupola roof panel, each said male snap-fit edge of said male cupola roof panel is assembled to an adjacent female snap-fit edge of another female cupola roof panel.

18. A cupola roof panel with snap-fit edges for a cupola roof, comprising:

at least three cupola roof panels, each said cupola roof panel having a top edge, bottom edge and two side edges;

a female snap-fit edge is disposed on one said side edge, said female snap-fit edge including a female channel offset from said female cupola roof panel at an obtuse angle, said female channel is terminated with a retention lip facing inward toward a center of said cupola roof panel, a tab extending outward from an end of said retention lip; and a male snap-fit edge is disposed on the other said side edge, said male snap-fit edge including a projection leg offset from said male cupola roof panel at an obtuse angle, a retention leg extending from said projection leg, wherein said male snap-fit edge is inserted into said female snap-fit edge until said retention leg is retained behind said retention lip, each said female snap-fit edge of said cupola roof panel is assembled to an adjacent male snap-fit edge of another cupola roof panel, each said male snap-fit edge of said cupola roof panel is assembled to an adjacent female snap-fit edge of another cupola roof panel.

* * * * *